US007753805B2

(12) United States Patent
Scaperotti

(10) Patent No.: US 7,753,805 B2
(45) Date of Patent: Jul. 13, 2010

(54) GOLF TRAINING DEVICE AND METHOD THEREOF

(76) Inventor: Michael John Scaperotti, 234 Rushmore Rd., Stormville, NY (US) 12582

( * ) Notice: Subject to any disclaimer, the term of this patent is extended or adjusted under 35 U.S.C. 154(b) by 0 days.

(21) Appl. No.: 12/460,466

(22) Filed: Jul. 20, 2009

(65) Prior Publication Data

US 2010/0022319 A1 Jan. 28, 2010

Related U.S. Application Data

(60) Provisional application No. 61/083,293, filed on Jul. 24, 2008.

(51) Int. Cl.
*A63B 69/36* (2006.01)

(52) U.S. Cl. ..... 473/228; 473/226; 473/256

(58) Field of Classification Search ..... 473/219, 473/226, 228, 229, 256; 150/160
See application file for complete search history.

(56) References Cited

U.S. PATENT DOCUMENTS

| | | | | |
|---|---|---|---|---|
| 3,398,961 | A * | 8/1968 | Higdon | 473/242 |
| 3,593,769 | A * | 7/1971 | Spears | 150/160 |
| 3,938,570 | A * | 2/1976 | Stewart | 150/160 |
| 4,444,396 | A | 4/1984 | Wendt | |
| 5,236,192 | A * | 8/1993 | Pitzel | 473/228 |
| 5,284,194 | A * | 2/1994 | Gaffney | 150/160 |
| 5,310,188 | A * | 5/1994 | Hernberg | 473/206 |
| 5,394,914 | A * | 3/1995 | Meek | 150/160 |
| 5,761,761 | A | 6/1998 | An | |
| 5,803,838 | A * | 9/1998 | DeMarini et al. | 473/437 |
| 6,358,157 | B1 | 3/2002 | Sorenson | |
| 6,716,111 | B2 * | 4/2004 | Liberatore | 473/256 |
| 7,118,490 | B2 | 10/2006 | Namba | |
| 7,144,339 | B1 | 12/2006 | Towsen | |
| 7,479,068 | B2 | 1/2009 | Ray | |
| 2004/0009823 | A1 | 1/2004 | Estebo | |
| 2006/0075589 | A1 | 4/2006 | Choi | |
| 2006/0287122 | A1 * | 12/2006 | Ray | 473/228 |

* cited by examiner

*Primary Examiner*—Nini Legesse
(74) *Attorney, Agent, or Firm*—Aziz M. Ahsan; Amsan & Associates, PLLC

(57) ABSTRACT

The present invention relates generally to a sports training device and method thereof. More particularly, the invention encompasses a flexible panel having a pocket for accommodating a golf club that is secured to the head of a golf club and used as a golf training device (GTD). The present invention is also directed to a novel method of training a golfer using the inventive golf training tool. The inventive golf training device may also be referred to as a lag rag or as a wind speed resistance trainer.

20 Claims, 3 Drawing Sheets

GOLF TRAINING DEVICE AND METHOD THEREOF

CROSS-REFERENCE TO RELATED APPLICATION

The instant patent application claims priority to and the benefit of pending U.S. Provisional Patent Application Ser. No. 61/083,293, filed on Jul. 24, 2008, titled "Wind Speed Resistance Trainer," the entire disclosure of which provisional application is incorporated herein by reference.

FIELD OF THE INVENTION

The present invention relates generally to a sports training device and method thereof. More particularly, the invention encompasses a flexible panel having a pocket for accommodating the head of a golf club and used as a golf training device (GTD). The present invention is also directed to a novel method of training a golfer using the inventive golf training tool. The inventive golf training device may also be referred to as a lag rag or as a wind speed resistance trainer.

BACKGROUND INFORMATION

Golf is a very popular sport throughout the world. Each year golfers spend millions of dollars on different aspects of this game. However, each golfer has a strong desire to improve his or her game and they spend substantial amount of monies for such improvements. For example, some golfers try to improve their game by having professionals give them training and lessons, while others try to improve their game by practicing the game on the golf course. Still others use a variety of golf training aids and devices to improve their game.

Presently there are numerous different golf swing training devices and tools that are available to the golfers so that they can improve their game.

For example, U.S. Pat. No. 4,444,396 (William P. Wendt), the entire disclosure of which is incorporated herein by reference, discloses an exercise device for improving a golf swing comprising a grip on an upper end of a shaft, a series of perforated circular discs weighing one, two, four, eight and sixteen ounces, respectively, adapted to fit securely on the shaft, proceeding geometrically in weight and a system for releasably securing any combination of the perforated discs on a lower end of the shaft.

Another golf swing trainer device is described in U.S. Pat. No. 6,358,157 (James W. Sorenson), the entire disclosure of which is incorporated herein by reference, where a golf swing strength trainer has a shaft of length not greater than that of a standard golf club shaft. A golf grip is fixed to one end of the shaft. A golf club head is fixed to the other end of the shaft. A pair of substantially equal weights is fixed concentrically on the shaft, one on each end of the grip, the center of gravity of the weights taken together being located substantially at a lengthwise center of the grip. Preferably, the weights abut the opposite ends of the grip. The muscles respond to the total weight of the trainer, which serves to increase strength, and which is the primary goal of the strength trainer.

U.S. Pat. No. 7,118,490 (Teruki Namba), the entire disclosure of which is incorporated herein by reference, discloses a golf swing training tool which comprises a plurality of blade portions and an attaching portion for detachably attaching these blade portions to an axial member for golf swinging, wherein the blade portions are radially disposed around an axis of the axial member when being attached to the axial member.

U.S. Pat. No. 7,479,068 (Lynn Ray), the entire disclosure of which is incorporated herein by reference, discloses a golf swing training device for improving muscle strength and club head speed. A golf swing training device comprising: a head cover, wherein the head cover further comprises a closure flap; at least one air catch coupled to the head cover, wherein the at least one air catch allows air to flow through; and a sock coupled to the at least one air catch. Alternate embodiments comprising: a head cover, wherein the head cover further comprises a closure flap; and at least one air catch coupled to the head cover wherein the at least one air catch comprises a pocket. Further embodiments comprising: a head cover, wherein the head cover further comprises an opening which allows a club shaft to pass through; at least one air catch coupled to the head cover; and a sock coupled to the at least one air catch.

However, there are still many problems with golf swing strength training tools and aids. For example, golf swing strength trainers that presently exist are heavy and/or awkward making them difficult to carry to and from the golf course or driving range. Also, current golf swing strength training aids are independent structures and do not attach to the golfers regular set of golf clubs. The difference between the grip on the golfer's regular clubs and the grip on any of the golf swing strength training aid may cause the golfer discomfort in switching back and forth between the clubs and the training aid. This discomfort may negatively impact the golfer's entire swing.

Accordingly, what is needed is a golf strength training aid that temporarily attaches to the golfer's regular set of clubs, and that is light and easy to carry to and from the driving range, and which also allows a golfer to practice their golf swings at most all locations where there is clearance to be able to swing a golf club.

Therefore, there is a need for an improvement in a golf training device and for a method thereof.

Furthermore, this invention improves on the deficiencies of the prior art and provides an inventive golf training device and a method thereof.

PURPOSES AND SUMMARY OF THE INVENTION

The invention is a novel golf training device and a method thereof.

Therefore, one purpose of this invention is to provide a golf training device and a method thereof.

Another purpose of this invention is to provide a golf training device that would help in improving a golfer's game.

Yet another purpose of this invention is to provide a robust, yet light weight, golf training device.

Still yet another purpose of this invention is to provide a golf training device which can be releasably attached and detached to a golf club head.

Therefore, in one aspect this invention comprises a golf swing training tool, comprising a first fold panel having at least one first securing tab, a base panel having at least one second securing tab, wherein said first fold panel is secured to said base panel so as to create a pocket for at least a portion of a golf club head, and wherein at least a portion of said at least one first securing tab is secured to at least a portion of said at least one second securing tab to form said golf swing training tool.

In another aspect this invention comprises a golf swing training device comprising:

(a) a panel having a first panel fold and a base panel;

(b) said first panel fold has at least one first securing tab;

(c) said base panel has at least one second securing tab;

(d) said first panel fold is secured to said base panel so at to form a club head pocket;

(e) said club head pocket receives and secures a golf club head; and (f) wherein at least a portion of said at least one first securing tab is secured to at least a portion of said at least one second securing tab so as to prevent any rotational movement of said golf club head, and thereby forming said golf swing training device.

BRIEF DESCRIPTION OF THE DRAWINGS

Although the scope of the present invention is much broader than any particular embodiment, a detailed description of the preferred embodiment follows together with drawings. These drawings are for illustration purposes only and are not drawn to scale. Like numbers represent like features and components in the drawings. The invention may best be understood by reference to the ensuing detailed description in conjunction with the drawings in which.

DETAILED DESCRIPTION

Figure 1:
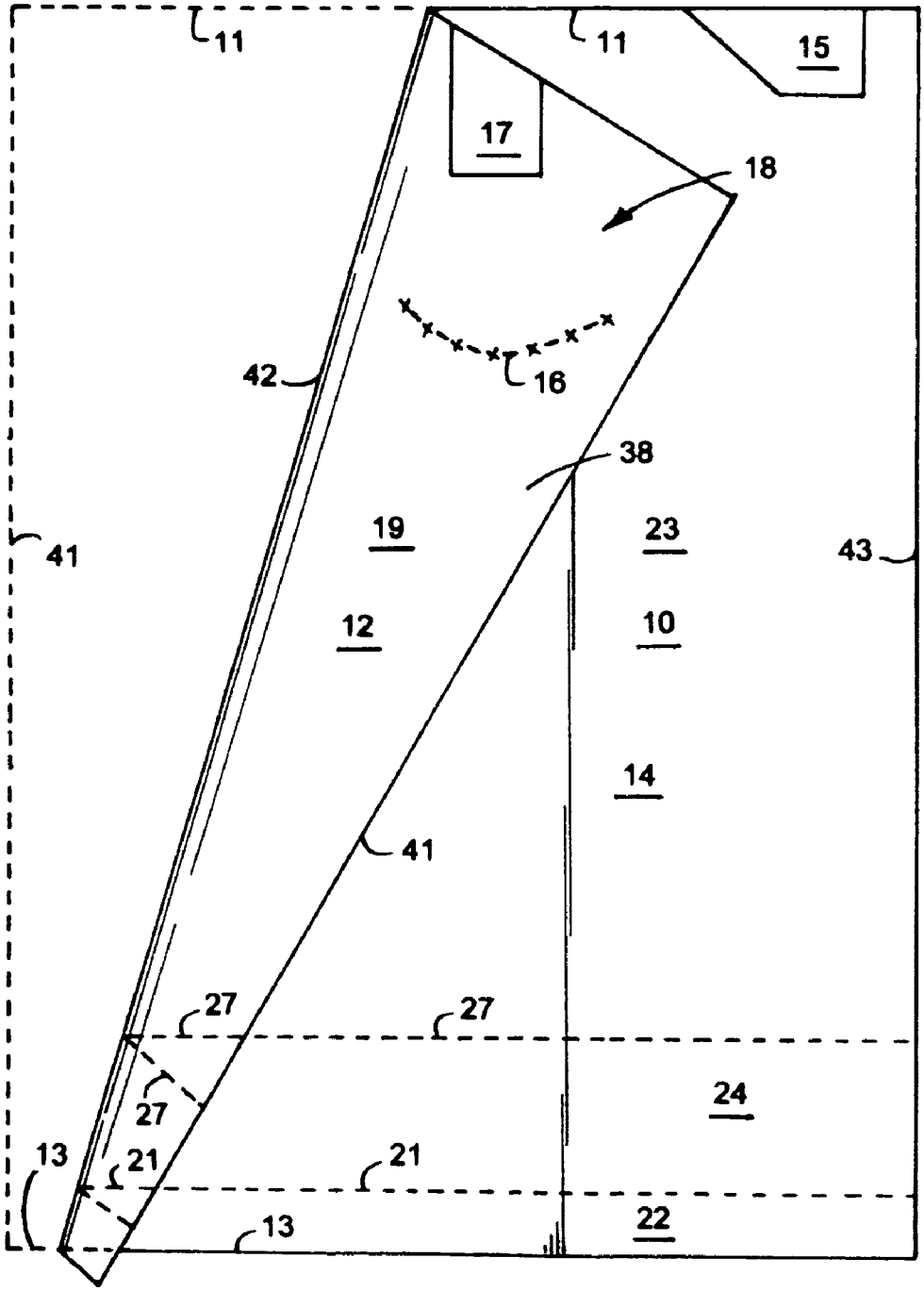
FIG. 1 illustrates a first embodiment of the inventive golf training device.

FIG. 1 illustrates a first embodiment of the inventive golf training device (GTD) or tool 23. The golf training device 23, comprises of at least one flat panel 10, such as, for example, cloth panel 10. The flat panel 10, has a first edge 11, such as, a top edge 11, a second edge 13, such as, a bottom edge 13, a first side edge 41, such as, a left side edge 41, a second side edge 43, such as, a right side edge 43. Preferably, the side edge 41, of the flat panel 10, is lifted and is folded from the first edge 11, such as, the top edge 11, to the second edge 13, such as, the bottom edge 13, so as to create a first panel fold 12, having a face portion 19, and a folded edge 42. The flat panel 10, now has a first panel fold 12, and a non-folded or a base panel 14. The first panel fold 12, is then secured to the base panel 14, via at least one securing means 16, so as to create at least one club head pocket 18. The first panel fold 12, also has at least one first securing tab 17, wherein the first securing tab 17, is located between the securing means 16, and the first edge 11, and wherein at least a portion of the first securing tab 17, is located on the face portion 19, of the first panel fold 12. For the purposes of illustration this embodiment is shown with the first side edge 41, folded over, however, one could fold the second edge 43, in order to form the golf head pocket 18. Preferably, between the area of the securing means 16, that the first edge 11, the non-folded or base panel 14, has at least one second securing tab 15. It is preferred that the folded edge 42, is at an angle and forms an angular edge 42, between the top edge 11, and the bottom edge 13. For some applications the edge 42, could be formed by securing the first panel 12, along the edge 42, to the base panel 14. The area between the first panel 12, and the base panel 14, below the securing means 16, and the club head pocket 18, creates a wind pocket 38, or a wind funnel 38. The wind funnel 38, helps channel the wind during the backward and forward swing of a golf club 20, shown in FIGS. 2 and 3. The channeling of the wind by the wind funnel 38, also acts as one of the components for creating the necessary drag on the golf club 20, during the swinging movement of the golf club 20.

Figure 2:
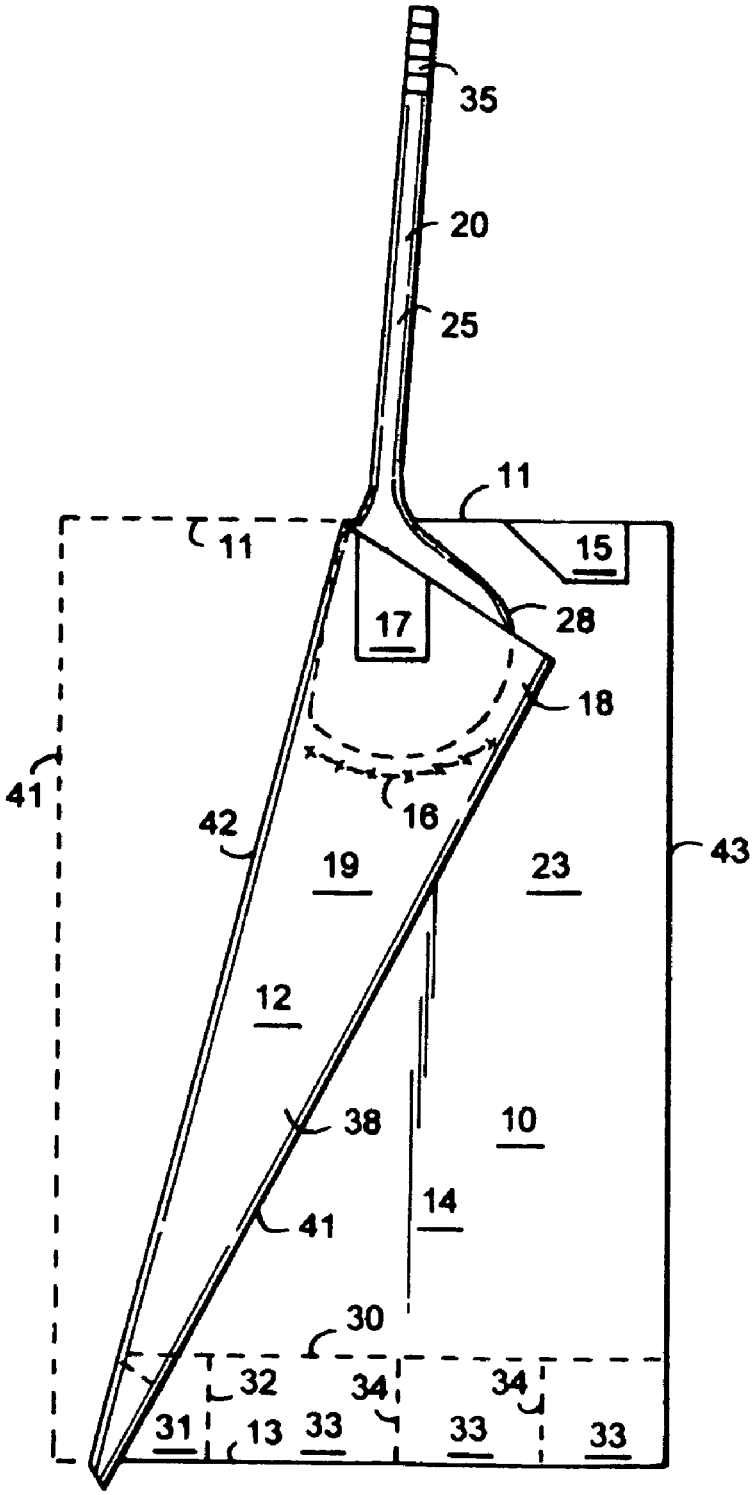
FIG. 2 illustrates a second embodiment of the inventive golf training device where a portion of the head of a golf club is partially enveloped by the inventive golf training device.

FIG. 2 illustrates a second embodiment of the inventive golf training device 23, where a portion of a golf club head 28, of a golf club 20, is partially enveloped by the inventive golf training device 23. A typical golf club 20, has a club stem 25, or club shaft 25, and on one end of the club shaft 25, is a grip 35, or grip area 35, and on the opposite end of the golf shaft 25, is the golf club head 28. Preferably, at least a portion of the golf club head 28, is inserted into at least a portion of the club head pocket 18, and the at least one second securing tab 15, on the base panel 14, is mated and secured to at least a portion of the at least one first securing tab 17, so as to prevent the slipping out of the golf club 20, from within the club head pocket 18, of the flat panel 10. For some applications the second securing tab 15, when secured to the first securing tab 17, may force a portion of the base panel 14, to completely wrap around the golf club head 28, thus making sure that the golf club head 28, is substantially inside the club head pocket 18.

Figure 3:
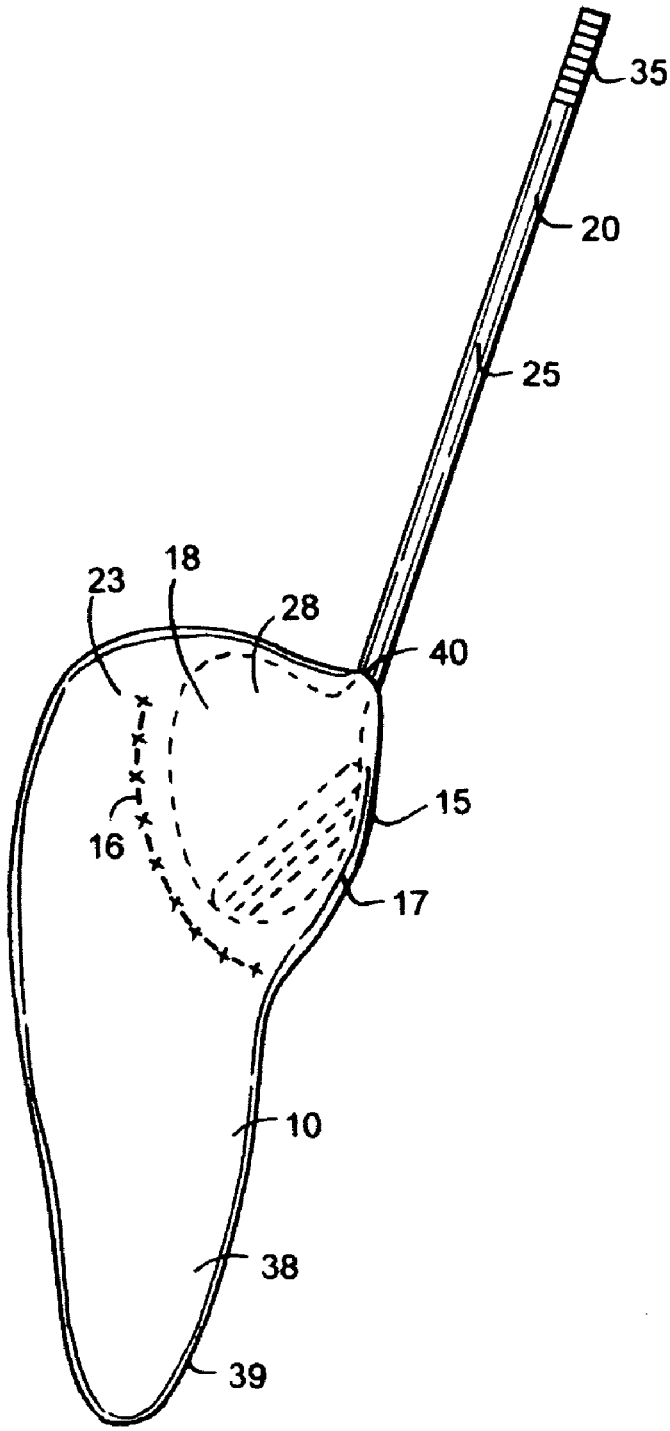
FIG. 3 illustrates a third embodiment of the inventive golf training device as secured to the golf club head.

FIG. 3 illustrates a third embodiment of the inventive golf training device 23, as secured to a golf club head 28. As one can see that the club head 28, is substantially inside the club head pocket 18, and a portion of the base panel 14, overlaps a portion of the first panel fold 12, thus creating a collar 40. For some applications the collar 40, may be around the lower end of the club stem or shaft 25. It is preferred that once the golf training device 23, is secured to a golf club 20, that there be no rotation of the panel 10, around the golf club head 28. This can be achieved in a number of ways, for example, one could secure the second securing tab 15, to the first securing tab 17, so as to create the collar 40, which is almost flush with the club head 28, or club stem 25. Once the golf securing device 23, is secured to the golf club head 28, the second edge 13, is free to hang loose with gravity and which would create a tail 39, or a trailing edge 39.

After the inventive golf training device 23, has been secured to the golf club 20, as shown in FIG. 3, a golfer (not shown) would hold the golf club 20, by the grip 35, and lift the golf club 20, in a typical golf swinging fashion, such that the tail 39, hangs loosely, due to gravity. When the golfer takes a swing with the golf training device 23, secured to the golf club 20, the tail 39, would substantially follow the golf club head 28, and create an air friction or air resistance. In some golf swing postures the tail 39, may not follow the swinging path of the golf club head 28, but may tend to swing towards a second swinging path, where the second swinging path may be directed towards the outside due to centrifugal forces.

For some applications the panel 10, as shown in FIG. 1, could have at least one panel or strip 22, wherein the strip 22, would be formed by a marking edge 21, and the bottom or second edge 13. Similarly, the panel 10, could have at least one additional strip 24, which would be formed by the marking edge 21, and a marking edge 27. The marking edge 21, 27, could be formed by a plurality of means, such as, for example, printing the marking edge 21, 27, creating a plurality of perforations along the marking edge 21, 27, to name a few. The primary purpose of the strips 22, 24, is to allow a golfer to cut or tear away the strip 22, and/or 24, as desired so as to change the weight of the panel 10, or the drag that is created by the tail 39, during the swinging movement of the golf club 20. The edge markings 21, 27, are shown as substantially parallel to the bottom edge 13, however the marking edges 21, 27, could be at an angle between the first side edge 41, and the second side edge 43, or could be formed either as a non-continuous edge 21, 27, or as a jagged edge 21, 27.

For some applications the panel 10, as shown in FIG. 2, could have at least one panel or strip 31, wherein the strip 31, would be formed by a marking edge 32, a side edge 41, an upper marking edge 30, and the bottom panel edge 13. Similarly, the panel 10, could have at least one additional strip 33, which would be formed by the marking edge 32, a marking edge 34, the upper marking edge 30, and the bottom panel edge 13. The marking edge 30, 32, 34, could be formed by a plurality of means, such as, for example, printing the marking edge 30, 32, 34, creating a plurality of perforations along the marking edge 30, 32, 34, to name a few. The primary purpose of the strips 31, 33, is to allow a golfer to cut or tear away the strip 31 and/or 33, as desired so as to change the weight of the panel 10, or the drag that is created by the tail 39, during the swinging movement of the golf club 20. For some applications the strips 31, 33, could be shaped like ribbons 31, 33, that are attached to the cloth material 10. The edge markings 32, 34, are shown as substantially parallel to the side edge 43, however the marking edges 32, 34, could be at an angle between the first side edge 41, and the second side edge 43, or could be formed either as a non-continuous edge 32, 34, or as a jagged edge 32, 34. A person skilled in the art understands that these markings can be used to form slits or can be used for trimming purposes. For other applications these markings could be used to form a wind tail, slits, ribbons, to name a few.

With this invention when a golfer (not shown) takes a swing with his golf club 20, with the inventive golf training device 23, attached thereto, there is no rotation of the inventive golf training device 23, around the golf club head 28, and thus forces the golf training device 23, to create the drag that would help improve a golfer's swing along with the golfer's game. The drag on the golf training device 23, is created from a multiple sources, such as, for example, gravity, the material of the golf device 23, the swinging trajectory of the golf club head 28, to name a few. Similarly, other sources of resistance are due to, for example, the added weight of the golf training device 23, which makes the golf club 20, slightly heavier to swing; the length of the golf training device 23, which drags behind the swinging club head 28, creating a centrifugal force as the golf club 20, swings in a circular motion; additionally, as the golf training device 23, is swung down, it acts like a parachute to catch air and create wind resistance, to name a few. It is preferred that during the golf swing that there is no rotation of the club head pocket 18, with respect to the golf club head 28.

As one can appreciate that with this invention a standard golf club 20, can be turned into a temporary training aid by the attachment of the inventive golf training device 23, to the club head 28. Therefore, with this invention a golfer can use their personal set of golf clubs and train with them without hitting a single golf ball. Similarly, the training experience a golfer gets using their own set of golf clubs substantially improves the golfing ability of the golfer.

As stated earlier that the golf training device 23, is attached to the club head 28, in a fashion that enables the golf club 20, to be swung vigorously with the golf training device 23, attached securely to the golf club head 28, and to be able to repeat the swinging movement without stopping, such as, to place a golf ball for each practice swing.

The at least one securing means 16, could be selected from a group comprising, a stitched seam, a permanent adhesive, a permanent weld, a permanent fusion of the first panel fold 12, with the corresponding location of the panel 10, around the area of the at least one securing means 16, to name a few.

The at least one first securing tab 17, could be selected from a group comprising, a Velcro, a temporary adhesive, a magnet secured to the first panel fold 12, around the area of the at least one first securing tab 17, to name a few.

The at least one second securing tab 15, could be selected from a group comprising, a Velcro, a temporary adhesive, a magnet secured to the base panel 14, around the area of the at least one second securing tab 15, to name a few.

The material for the panel 10, could be selected from a group comprising, a cloth material, a cotton material, a polyester material, a terry cloth type material, a micro-fibrous material, a fibrous composite material, to name a few.

As stated earlier that the inventive golf training device 23, is basically designed to attach to the club head 28, of a golf club 20. The inventive golf training device 23, works on the concept of speed or wind resistance. With speed, as the golf training device 23, is swung, it creates resistance through the area of the swing where the golf ball would normally be. Because the golf training device 23, does not involve the actual hitting of a golf ball, it can be utilized almost anywhere what a golf club 20, can be safely swung. As one can see that the golf training device 23, can be easily, and securely attached to a golf club 20, in a very short time.

The golf training device 23, works extremely well on the golf muscles of a golfer, and in a matter of a very short time the golf muscles will feel the effects of the wind resistance. With this invention a golfer can train their golf muscles using their own set of clubs and at their own convenience. This of course saves a golfer time and monies by eliminating the many trips to the driving range. Another advantage with this invention is that the golfer gets a good workout using the inventive golf training device 23, without the need to stop and place a golf ball before each practice hit.

Additionally, the golf training device 23, creates such resistance with speed that a good workout is achieved in a very short period of time. This is achieved as the faster the golfer swings the golf club 20, the more resistance the golf training device 23, creates, and that force that is created against the golf swing is then displaced or transferred onto the muscles involved. The muscles then respond naturally by applying more force against the wind resistance created by the arcuate movement of the golf training device 23.

With this invention, after a minimal use, a golfer will have more power in their golf swing. A golfer could also use the inventive golf training tool 23, to help them with the timing between the lower body and waist, through the mid-section to the shoulders and arms, and finally the forearms and wrists for a total rhythmic and powerful golf swing.

After the golf training device 23, is removed from the golf club 20, it can also be used as golf bag hand towel or as a cleaning device for the golf clubs 20, golf balls, or similar other items. One could also put corporate logos or similar indicia on the golf training tool 23.

One of the advantages of this invention is that it allows the maximization of a golfer's swing speed by building up all the muscles involved in the golf swing. Additionally, this invention gives the golfers with limited time the ability to make major improvements to their swing in a minimal amount of time. This invention can be used anywhere where a golf club 20, can be swung safely, such as, for example, a yard, a driveway, a sidewalk, a park, to name a few. The golf training device can also be used prior to teeing off for a round of golf to loosen up ones golf swing, thus making a golfer more prepared to play.

It should be appreciated that the golf training device or tool 23, fits snugly around the golf club head 28, and does not rotate around the golf club head 28, when the golf club 20, is lifted or during the swinging motion of the golf club 20.

Similarly, any portion of the golf training device 23, can be adjusted or shaped to change the resistance levels, as desired by the golfer (not shown).

This invention also helps at the very start or take off of the club 20. Similarly, by creating a dragging weight it helps to make the forearms and shoulders drag the club 20, back to the top of the swing. This prevents too much wrist hinge lifting the club 20. As one can appreciate that golf training device 23, helps not only during the rearward or backward movement of the golf club 20, but also during the forward movement of the golf swing.

While the present invention has been particularly described in conjunction with a specific preferred embodiment, it is evident that many alternatives, modifications and variations will be apparent to those skilled in the art in light of the foregoing description. It is therefore contemplated that the appended claims will embrace any such alternatives, modifications and variations as falling within the true scope and spirit of the present invention.

What is claimed is:

1. A golf swing training tool, comprising a flexible panel, wherein said flexible panel comprises a first fold panel having at least one first securing tab, a base panel having at least one second securing tab, wherein said first fold panel is secured to said base panel via at least one securing means so as to create a pocket for at least a portion of a golf club head, and said pocket adapted to accept at least a portion of a golf club head of a golf club, and wherein at least a portion of said at least one first securing tab is secured to at least a portion of said at least one second securing tab such that a portion of said base panel wraps around a portion of said pocket for at least a portion of a golf club head, and wherein a portion of said base panel below said at least one securing means forms a wind funnel, and wherein said at least one securing means separates said pocket for at least a portion of a golf club head from said wind funnel, and wherein when said golf club is swung said wind funnel trails said golf club head.

2. The golf swing training tool of claim 1, wherein said first fold panel is permanently secured to said base panel.

3. The golf swing training tool of claim 1, wherein said first fold panel is permanently secured to said base panel, and wherein a secured area in substantially in a shape of an arc is formed where said first fold panel is permanently secured to said base panel.

4. The golf swing training tool of claim 1, wherein said at least one securing means is selected from a group consisting of a stitched seam, a permanent adhesive, a permanent weld, and a permanent fusion of said first panel fold to a corresponding location on said base panel around said area of said at least one securing means.

5. The golf swing training tool of claim 1, wherein said at least one first securing tab is selected from a group comprising a hook and loop-type fastener, a temporary adhesive, and a magnet secured to said first panel fold around the area of said at least one first securing tab.

6. The golf swing training tool of claim 1, wherein said at least one second securing tab is selected from a group comprising a hook and loop-type fastener, a temporary adhesive, and a magnet secured to said first panel fold around the area of said at least one second securing tab.

7. The golf swing training tool of claim 1, wherein material for said panel is selected from a group consisting of a cloth material, a cotton material, a polyester material, a terry cloth type material, a micro-fibrous material, and a fibrous composite material.

8. The golf swing training tool of claim 1, wherein said golf training tool has at least one marking.

9. The golf swing training tool of claim 1, wherein said golf training tool has at least one marking, and wherein said marking is selected from a group consisting of at least one corporate logo, and at least one visible indicia.

10. The golf swing training tool of claim 1, wherein said golf training tool has at least one marking, and wherein said marking is selected from a group consisting of edge marking, perforated marking, strip marking, panel marking, and surface marking.

11. A golf swing training device comprising:

(a) a flexible panel, wherein said flexible panel comprises a first panel fold and a base panel;

(b) said first panel fold has at least one first securing tab;

(c) said base panel has at least one second securing tab;

(d) said first panel fold is secured to said base panel via at least one securing means so at to form a club head pocket, and said club head pocket adapted to accept at least a portion of a golf club head of a golf club;

(e) said club head pocket receives and secures a golf club head; and (f) wherein at least a portion of said at least one first securing tab is secured to at least a portion of said at least one second securing tab so as to prevent any rotational movement of said golf club head, and wherein a portion of said base panel wraps around a portion of said club head pocket, and wherein a portion of said base panel below said at least one securing means forms a wind funnel, and wherein said at least one securing means separates said club head pocket from said wind funnel, and wherein when said golf club is swung said wind funnel trails said golf club head.

12. The golf swing training device of claim 11, wherein said first fold panel is permanently secured to said base panel.

13. The golf swing training device of claim 11, wherein said first fold panel is permanently secured to said base panel, and wherein a secured area in substantially in a shape of an arc is formed where said first fold panel is permanently secured to said base panel.

14. The golf swing training device of claim 11, wherein said at least one securing means is selected from a group consisting of a stitched seam, a permanent adhesive, a permanent weld, and a permanent fusion of said first panel fold to a corresponding location on said base panel around said area of said at least one securing means.

15. The golf swing training device of claim 11, wherein said at least one first securing tab is selected from a group comprising a hook and loop-type fastener, a temporary adhesive, and a magnet secured to said first panel fold around the area of said at least one first securing tab.

16. The golf swing training device of claim 11, wherein said at least one second securing tab is selected from a group comprising a hook and loop-type fastener, a temporary adhesive, and a magnet secured to said first panel fold around the area of said at least one second securing tab.

17. The golf swing training device of claim 11, wherein material for said panel is selected from a group consisting of a cloth material, a cotton material, a polyester material, a terry cloth type material, a micro-fibrous material, and a fibrous composite material.

18. The golf swing training device of claim 11, wherein said golf training tool has at least one marking.

19. The golf swing training device of claim 11, wherein said golf training tool has at least one marking, and wherein said marking is selected from a group consisting of at least one corporate logo, and at least one visible indicia.

20. The golf swing training device of claim 11, wherein said golf training tool has at least one marking, and wherein said marking is selected from a group consisting of edge marking, perforated marking, strip marking, panel marking, and surface marking.

* * * * *